United States Patent [19]

Pappal et al.

[11] Patent Number: 5,062,945

[45] Date of Patent: Nov. 5, 1991

[54] METHOD OF FCC SPENT CATALYST STRIPPING FOR IMPROVED EFFICIENCY AND REDUCED HYDROCARBON FLOW TO REGENERATOR

[75] Inventors: David A. Pappal, Haddonfield, N.J.; Paul H. Schipper, Wilmington, Del.

[73] Assignee: Mobil Oil Corporation, Fairfax, Va.

[21] Appl. No.: 423,610

[22] Filed: Oct. 16, 1989

Related U.S. Application Data

[63] Continuation of Ser. No. 248,058, Sep. 23, 1988, abandoned.

[51] Int. Cl.[5] ..... C10G 11/18

[52] U.S. Cl. ..... 208/113; 208/150; 208/160; 208/164

[58] Field of Search ..... 208/113, 150, 161, 164, 208/160

[56] References Cited

U.S. PATENT DOCUMENTS

| | | | |
|---|---|---|---|
| 3,008,896 | 11/1961 | Lawson | 208/150 |
| 3,392,110 | 7/1968 | Payne | 208/153 |
| 4,043,899 | 8/1977 | Anderson et al. | 208/161 |
| 4,070,159 | 1/1978 | Myers et al. | 23/288 |
| 4,356,082 | 10/1982 | Gross | 208/164 |
| 4,411,773 | 10/1983 | Gross | 208/164 |
| 4,419,221 | 12/1983 | Castagnos et al. | 208/133 |
| 4,464,250 | 8/1984 | Myers et al. | 208/164 |
| 4,574,044 | 3/1986 | Krug | 208/120 |
| 4,689,206 | 8/1987 | Owen et al. | 422/144 |
| 4,724,065 | 2/1988 | Bartholic et al. | 208/91 |
| 4,786,622 | 11/1988 | Walters et al. | 208/164 |
| 4,871,446 | 10/1989 | Herbst et al. | 208/113 |
| 4,917,790 | 4/1990 | Owen | 208/113 |
| 4,971,681 | 11/1990 | Harandi et al. | 258/160 |
| 4,973,398 | 11/1990 | Pappal et al. | 258/159 |

*Primary Examiner*—Anthony McFarlane

*Attorney, Agent, or Firm*—Alexander J. McKillop; Charles J. Speciale; Robert B. Furr, Jr.

[57] ABSTRACT

A method and apparatus are disclosed to reduce the amount of unstripped hydrocarbon flowing to the regenerator in an FCC unit. The catalyst stripper section is heated by indirect heat exchange with a mixture of hot regenerator flue gas and regenerated catalyst.

10 Claims, 2 Drawing Sheets

90
80
96
60
58
54
56
46
47
48
44
36
40
49
62
38
52
34
32
35
100
101
81
72
6
8
28
24
26
17
11
4
16
14
74b
73
74c
74a
76
75
75
71
70
2

METHOD OF FCC SPENT CATALYST STRIPPING FOR IMPROVED EFFICIENCY AND REDUCED HYDROCARBON FLOW TO REGENERATOR

CROSS-REFENCE TO RELATED APPLICATION

This is a continuation of copending application Ser. No. 248,058, filed on Sept. 23, 1988 now abandoned, which is related to commonly-assigned application Ser. No. 198,263, filed May 25, 1988.

BACKGROUND OF THE INVENTION

This invention relates to a method and apparatus for the separation of entrained cracked products from a fluidized finely divided solid catalyst in a fluidized catalytic cracking unit (FCC). More particularly, it relates to an improved method and apparatus for separating catalyst from a catalytically cracked product in a catalyst stripper zone to minimize or substantially eliminate flow of valuable cracked product to the regenerator.

The field of fluid catalytic cracking has undergone significant improvements relating both to catalyst technology and to mechanical process unit design. These advances have enabled refiners to process heavier feedstocks as well as to increase the total yields of gasoline and distillate. However, the significant potential for process improvement resulting from eliminating or substantially reducing flow of cracked products to the regenerator has not been fully realized.

By way of background, the hydrocarbon conversion catalyst usually employed in an FCC unit is preferably a high activity crystalline zeolite catalyst of a fluidizable particle size. The catalyst is transferred in suspended or dispersed phase condition generally upwardly through one or more riser conversion zones (FCC cracking zones) providing a hydrocarbon residence time in each conversion zone in the range of 0.5 to about 10 seconds, and usually less than about 8 seconds. High temperature riser hydrocarbon conversions, occurring at temperatures of at least 1000° F. or higher and at 0.5 to 4 seconds hydrocarbon residence time in contact with the catalyst in the riser, are desirable for some operations before initiating separation of vapor phase hydrocarbon product materials from the catalyst. Rapid separation of catalyst from hydrocarbons discharged from a riser conversion zone is particularly desirable for restricting hydrocarbon conversion time. It is also highly desirable to strip hydrocarbon product materials from the catalyst before the catalyst enters a regeneration zone. During the hydrocarbon conversion step, carbonaceous deposits accumulate on the catalyst particles and the particles entrain hydrocarbon vapors upon removal from the hydrocarbon conversion step. The entrained hydrocarbons are removed from the catalyst in a separate catalyst stripping zone. Hydrocarbon conversion products separated from the catalyst and stripped materials are combined and passed to a product fractionation step. Stripped catalyst containing deactivating amounts of carbonaceous material, referred to as coke, is then passed to a catalyst regeneration operation.

Coke deposited on deactivated FCC catalyst together with entrained product which is carried over to the regenerator with the deactivated catalyst is referred to by those skilled in the art as "total delta carbon." For a given FCC unit design, at a fixed catalyst circulation rate, an increase in total delta carbon is accompanied by higher regenerator temperatures. Consequently, one method of limiting FCC regenerator temperature is to reduce total delta carbon by reducing carryover of cracked hydrocarbon product to the regenerator.

Methods and systems for separating catalyst particles from a gas suspension phase containing catalyst particles and hydrocarbon vapors, particularly the separation of high activity crystalline zeolite cracking catalysts, have been the subject of recent advances in the art.

Anderson et al U.S. Pat. No. 4,043,899 discloses a method for rapid separation of a product suspension comprising fluidized catalyst particles and the vapor phase hydrocarbon product mixture, by discharging the entire suspension directly from the riser conversion zone into a cyclone separation zone. The cyclone is modified to include a separate cyclonic stripping of the catalyst separated from the hydrocarbon vapors. In the method of Anderson et al, the cyclone separator is modified to include an additional downwardly extending section comprising a lower cyclone stage. In this arrangement, catalyst separated from the gasiform material in the upper stage, slides along a downwardly sloping baffle to the lower cyclone where stripping steam is introduced to further separate entrained hydrocarbon products from the catalyst recovered from the upper cyclone. The steamed and stripped hydrocarbons are passed from the lower cyclone through a concentric pipe where they are combined with the hydrocarbon vapors separated in the upper cyclone. The separated and stripped catalyst is collected and passes from the cyclone separator by conventional means through a dipleg.

Myers et al U.S. Pat. No. 4,070,159 provides a separation means whereby the bulk of catalyst solids is discharged directly into a settling chamber without passing through a cyclone separator. In this apparatus, the discharge end of the riser conversion zone is in open communication with the disengaging chamber such that the catalyst discharges from the riser in a vertical direction into the disengaging chamber which is otherwise essentially closed to the flow of gases. The cyclone separation system is in open communication with the riser conversion zone by means of a port located upstream from, but not near, the discharge end of the riser conversion zone. A deflector cone mounted directly above the terminus of the riser causes the catalyst to be directed in a downward path so as to prevent the catalyst from abrading the upper end of the disengaging vessel. The cyclone separator is of the usual configuration employed in a catalytic cracking unit to separate entrained catalyst particles from the cracked hydrocarbon products so that the catalyst passes through the dipleg of the cyclone to the body of the catalyst in the lower section of the disengaging vessel, and the vapor phase is directed from this vessel to a conventional fractionation unit. There is essentially no net flow of gases within the disengaging vessel beyond that resulting from a moderate amount of steam introduced to strip the catalyst residing in the bottom of the disengaging vessel.

It is also known to transfer thermal energy from the regenerator to the reactor. Gross U.S. Pat. Nos. 4,356,082 and 4,411,773 teach a fluid catalytic cracking (FCC) process and apparatus wherein the heat balance between the reactor and the regenerator of the FCC operation is partially uncoupled by transferring at least a portion of thermal energy from the reactor vessel riser to the regenerator vessel. The transfer of thermal energy results in a higher regenerating temperature. The thermal energy is recirculated to the upstream section of the reactor riser through a regenerated catalyst having higher temperature. As a result, the outlet of the reactor vessel is maintained at a substantially constant temperature (about 1000° F.) and the rate of conversion of the oil feed and the octane number of gasoline produced in the process are increased.

Krug U.S. Pat. No. 4,574,044 discloses a method for increasing the overall efficiency of an FCC process by decreasing the amount of valuable product burned in the regenerator. Separation of catalyst from hydrocarbon product is enhanced by first stripping the hydrocarbon product from the catalyst and then conditioning the catalyst in the presence of steam at elevated temperatures for a period of about ½ to 30 minutes. The benefits of this system include a reduction in coke make.

Owen et al U.S. Pat. No. 4,689,206 teaches an apparatus for fluid catalytic cracking (FCC) of a hydrocarbon feed in an open or closed system, which includes a multi-stage stripper system, which comprises a means for spinning a gasiform mixture of catalyst and cracked hydrocarbons exiting from a riser, a first means for stripping the spun gasiform mixture, and a means for deflecting the gasiform mixture to separate catalyst from the cracked hydrocarbons.

Commonly-assigned U.S. patent application Ser. No. 903,365 filed Sept. 3, 1986, of Herbst et al discloses a technique for improving the efficiency of a catalyst stripper section by injecting an inert gas and heating the stripper section by carrying out an exothermic reaction within the stripper.

FCC regenerators with catalyst coolers are disclosed in U.S. Pat. Nos. 2,377,935; 2,386,491; 2,662,050; 2,492,948 and 4,374,750 inter alia.

SUMMARY OF THE INVENTION

It is an object of the present invention to provide a catalyst stripping process and apparatus which significantly reduces unstripped hydrocarbon flowing to the regenerator.

It is a further object of the present invention to improve the yield of valuable product by reducing or eliminating flow of cracked product to the regenerator.

It is a further object of the present invention to reduce the emission of $SO_x$ and $NO_x$ produced by the combustion of cracked product in the regenerator.

It is a further object of this invention to reduce the partial pressure of water in the regenerator to reduce the degree of steaming deactivation of the catalyst, thereby increasing catalyst life and reducing fresh catalyst makeup requirements.

It is a further object of this invention to cool the regenerated catalyst before the catalyst enters the reactor riser.

Briefly, the present invention improves stripping efficiency in an FCC catalyst stripper by indirectly heating the stripper section with hot regenerated catalyst fluidized in a stream of regenerator flue gas. More particularly, the method of the present invention achieves the above and other objects by the steps of: mixing a hydrocarbon feed with a regenerated catalyst in the lower section of a reactor riser; passing the mixture through the length of the reactor riser under conversion conditions whereby the hydrocarbon is catalytically cracked and the catalyst is deactivated; separating cracked product from deactivated catalyst; charging the deactivated catalyst to a stripping zone; withdrawing deactivated catalyst from the stripping zone; regenerating the withdrawn deactivated catalyst in a regeneration zone whereby a hot flue gas is generated; withdrawing a portion of the regenerated catalyst; fluidizing the regenerated catalyst in a stream of the hot flue gas; transferring at least a portion of the thermal energy of the regenerated catalyst and the hot flue gas to the stripping zone whereby the mixture of hot flue gas and regenerated catalyst is cooled and the stripping zone is heated.

The method may also include transferring thermal energy from hot flue gas and regenerated catalyst to the stripping zone by maintaining conduit means within the stripping zone and passing regenerated catalyst fluidized in a stream of hot flue gas through the conduit means at a flow rate such that the stripping zone is heated to a temperature sufficient to enhance separation of catalyst and hydrocarbon product. The cooled regenerated catalyst and flue gas are then mixed with hot regenerated catalyst and charged to the reactor riser. Alternatively, the cooled regenerated catalyst and flue gas may be returned to the regenerator.

The present invention achieves the above and other objects in an apparatus for separating entrained hydrocarbon vapors from a fluidized catalyst bed comprising a longitudinally extensive cylindrical reactor shell having inlet and outlet ports; a cylindrical riser conduit extending longitudinally through said reactor shell; a plurality of frustoconical members attached to the inner surface of the reactor shell; a plurality of frustoconical members attached to the outer surface of the riser conduit; and conduit means extending through the reactor shell for providing indirect heat exchange between a fluidized mixture of hot flue gas and a finely divided solid flowing through the conduit means and the gaseous stream containing solid catalyst flowing around the outer surface of the conduit means.

The apparatus may further comprise a multiple-tube heat exchanger positioned in the annular space between the outside surface of the riser conduit and the inside surface of the reactor shell.

The apparatus may further comprise flow control means for controlling the regenerated catalyst and hot flue gas flow rates through the tubes to maintain a desired temperature in the catalyst stripper.

The present invention reduces coke loading on deactivated catalyst by reducing the amount of valuable product carried over to the regenerator. This lowers regenerator temperature for a given catalyst circulation rate. Cooler regenerated catalyst permits operation at an increased catalyst to oil ratio and consequently increases conversion.

DETAILED DESCRIPTION

Figure 1:
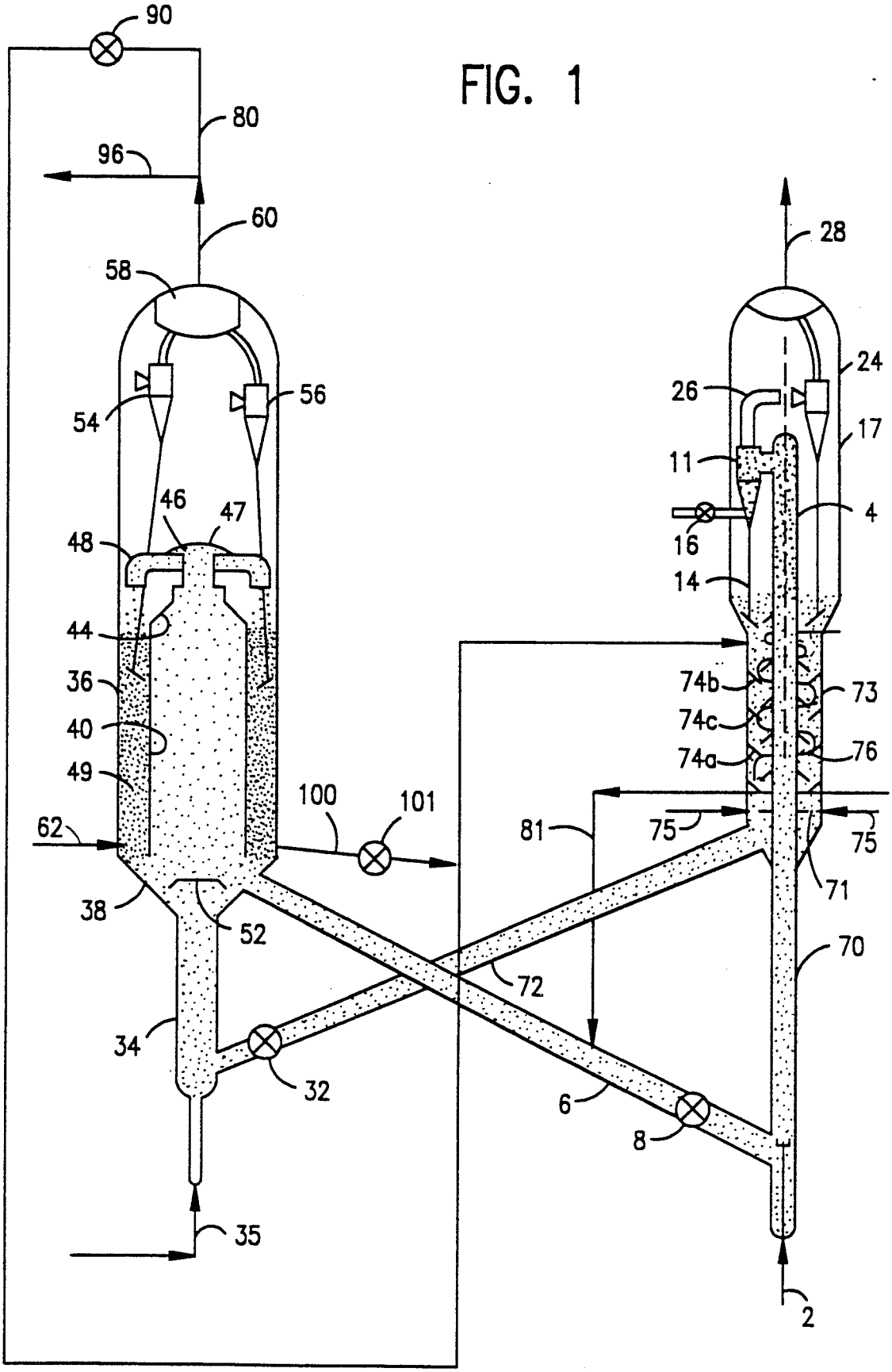
FIG. 1 is a simplified schematic diagram showing the major components of an FCC unit wherein regenerated catalyst fluidized in a stream of flue gas provides thermal energy to heat the catalyst stripper section.

Referring to FIG. 1, a hydrocarbon oil feed such as gas oil or higher boiling material is introduced through a conduit 2 to the bottom or upstream section of a riser reactor 70. Hot regenerated catalyst is also introduced to the bottom section of the riser by a standpipe 6 equipped with a flow control valve 8. A vapor liquid suspension is formed in the lower bottom section of the riser 70 at an elevated temperature at about 525° C. to 650° C. (980° F. to 1200° F.) and is usually at least 540° C. (1000° F.), depending on the degree of hydrocarbon conversion desired and on the composition of the feed. The suspension is formed in the bottom section of the riser and is passed upwardly through the riser under selected temperature and residence time conditions. Residence of the hydrocarbon charge stock in the riser is usually between 0.1 and 15 seconds, typically 0.5 to 4 seconds, before the suspension passes through suitable separating means, such as a series of cyclones 11 rapidly effecting separation of catalyst particles from vapor hydrocarbon conversion products. Thus, in the apparatus shown in FIG. 1, the suspension is discharged from the riser 70 into one or more cyclonic separators attached to the end of the riser and represented by a separator means 11. Catalyst particles separated in the cyclone 11 pass countercurrently in contact with stripping gas introduced by conduit 16 to a lower portion of the cyclone. Thus, the contacted and separated catalyst is withdrawn by a dipleg 14 for discharge into a bed of catalyst in the lower section of the reactor.

The end of the riser 70 with attached separation means 11 as shown in FIG. 1 is housed in the larger vessel 17 designated herein as a receiving and catalyst collecting vessel. The lower portion of the vessel 17 has generally a smaller diameter than the upper portion thereof and comprises a catalyst stripping section 73 to which a suitable stripping gas, such as steam, is introduced, e.g. by a conduit 75. The stripping section is provided with a plurality of frustoconical baffles 74A, 74B and 74C (only three are designated) over which the downflowing catalyst passes countercurrently to upflowing stripping gas.

Hot flue gas is withdrawn from plenum section 58 of regenerator vessel 36 through conduit 60. Control valve 90 positioned in line 80 sets the flowrate of hot flue gas flowing from the regenerator vessel 36 to the stripping section 73. Hot regenerated catalyst is withdrawn from the regenerator vessel 36 through line 100 which is equipped with control valve 101 and flows into line 80 where it is fluidized in a stream of hot flue gas. The fluidized mixture flows through line 80 into heat exchanger conduit 76 positioned inside the stripping section 73. While line 80 is illustrated as entering stripping section 73 near the top, it is to be understood that the present invention encompasses both downflow and upflow embodiments. Consequently, line 80 may alternatively be positioned near the bottom of stripper section 27. A compressor 85 may optionally be installed in line 80 to facilitate flow of flue gas and fluidized catalyst through line 81 into standpipe 6.

Once inside the stripper section 27, the conduit means may comprise a heat exchanger conduit 76 passing helically between the baffles, or the conduit may comprise a plurality of vertical or horizontal tubes (not shown).

The fluidized mixture of flue gas and regenerated catalyst enters the heat exchanger conduit 76 at between about 650° C. and 760° C. (1200° F. and 1400° F.) and leaves the stripping section at a temperature between about 590° C. and 710° C. (1100° F. and 1300° F.). The cooled fluidized mixture from heat exchanger conduit 76 flowing through line 81 flows into regenerated catalyst standpipe 6. Alternatively, the cooled fluidized mixture may be returned to the regenerator. As mentioned above, line 80 may enter stripper section 27 near the bottom. If line 80 is positioned near the bottom for upflow operation, then line 81 will be positioned near the top of stripper section 27.

Regenerated catalyst and flue gas flowrates are controlled to increase the temperature in the stripper section 27 sufficiently to achieve enhanced separation between catalyst and reaction products in the stripper. This temperature increase should exceed about 28° C. (50° F.).

A cyclone 24 is provided in the upper portion of the vessel 16 for recovering stripped hydrocarbon products and stripping gas from entrained catalyst particles. As is well known in the art, there may also be provided a second sequential stage (not shown) of catalyst separation for product vapors discharged from the separator 11 by a conduit 26.

Deactivated stripped catalyst is withdrawn from the bottom of the stripping section at an elevated temperature which may vary with individual unit operation but typically ranges between about 560° C. and 600° C. (1050° F. to 1100° F.), by a standpipe 72 equipped with a flow control valve 32. The catalyst is then passed from the standpipe 72 into the bottom portion of a regenerator riser 34. A regeneration gas is introduced into the bottom of riser 34 through a conduit 35. The regeneration gas may comprise air or may optionally comprise preheated air or oxygen supplemented air at about 150° C. to 260° C. (300° F. to 500° F.) and about 270 kPa (25 psig) to 450 kPa (50 psig), typically about 380 kPa (40 psig). The amount of lift gas introduced into the regenerator riser is sufficient for forming a suspension of catalyst in lift gas, which suspension is forced to move upwardly through riser 34 under incipient or partial regenerator conditions and into the bottom portion of an enlarged regenerator vessel 36. Regenerator vessel 36 comprises a bottom closure member 38 shown in the drawing to be conical in shape. Other suitable shapes obvious to those skilled in the art may also be employed, such as rounded dish shapes.

The regenerator vessel 36 comprises a smaller diameter cylindrical vessel means 40 in the lower section provided with a cylindrical bottom containing a cyclindrical opening, whose cross section is at least equal to the cross section of the riser 34. An annular space 49 is formed by the chambers 36 and 40 and serves to recirculate regenerated catalyst to the dense bed.

Vessel 40 is provided with a conical head member 46 terminating in a relatively short cylindrical section of sufficient vertical height capped at its upper end by means 47 to accommodate a plurality of radiating arm means 48. The radiating arm means 48 are opened on the bottom side and operate to discharge a concentrated stream of catalyst substantially separated from the combustion product gases generally downward into the space 49.

In the upper portion of vessel 36, a plurality of cyclonic separators 54 and 56 is provided for separating combustion flue gas from entrained catalyst particles. The separated flue gas passes into plenum 58 for withdrawal by a conduit 60. A controlled amount of flue gas is routed to the catalyst stripper section 73 through conduit 80 as described above. The balance of the flue gas is sent to a heat recovery section, e.g. steam generation, through conduit 96.

The illustrated catalyst regenerator operation is designed to provide regenerated catalyst at an elevated temperature above 450° F. and preferably at 1300° F. to 1500° F. having residual coke on catalyst of less than about 0.15 and typically 0.1 to 0.01 weight percent. However, the process of the present invention can be successfully used with any regenerator coupled to an FCC reactor. Accordingly, the regenerator operation illustrated in the embodiment of FIG. 1 is used as an example of one suitable regenerator and is not to be considered a limitation of the present invention.

Figure 2:
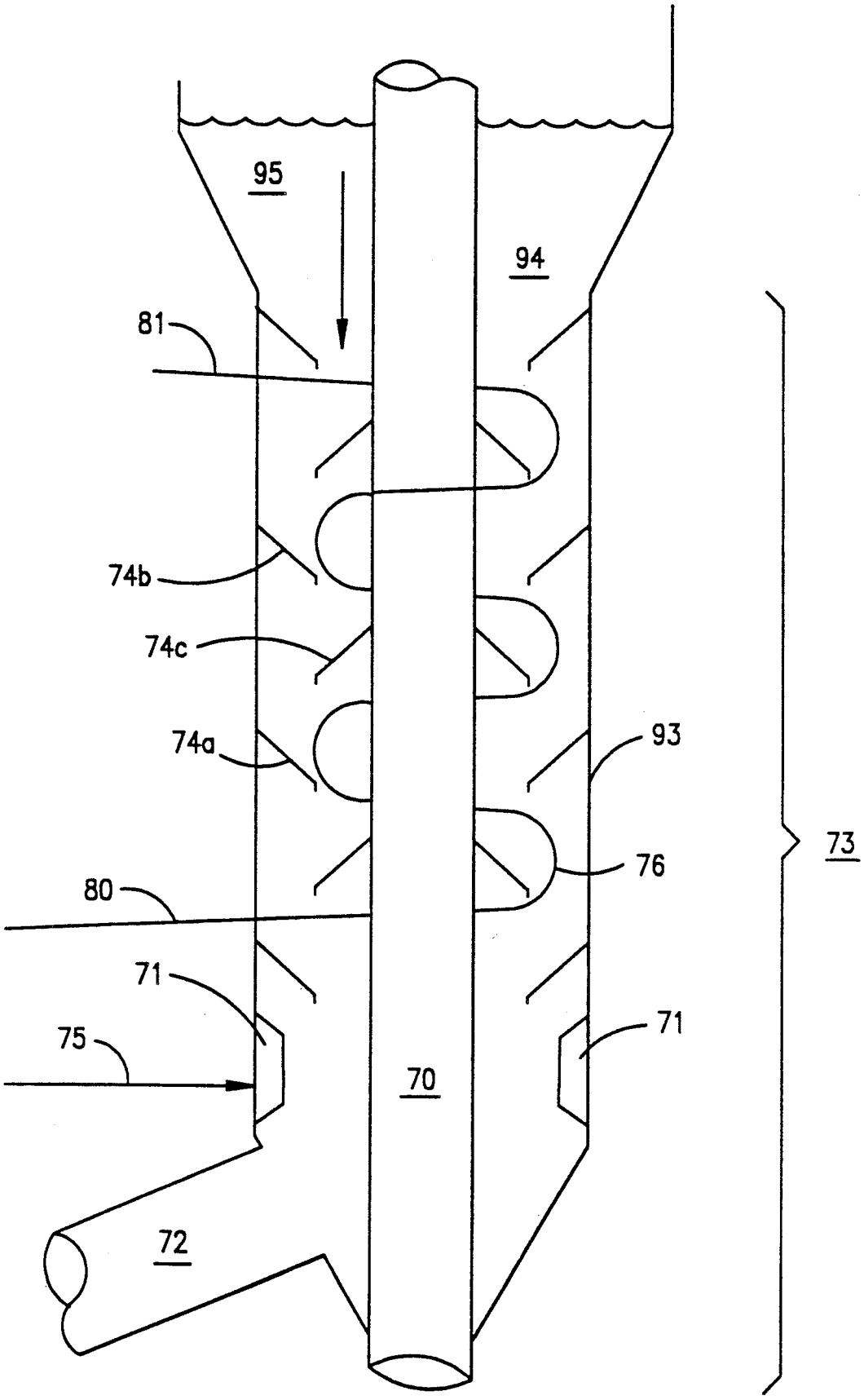
FIG. 2 is a simplified schematic diagram showing an FCC unit reactor riser and spent catalyst stripper including the novel catalyst stripper design of the present invention.

FIG. 2 details the catalyst stripper section of reactor vessel 17 shown in FIG. 1. The catalyst stripper section 73 comprises a cylindrical longitudinally extensive outer shell 93 having a plurality of frustoconical members 74A and 74B (only two are designated) attached to the inner surface thereof. Riser conduit 70 extends longitudinally through the stripper section and is equipped with a plurality of frustoconical members 74C (only one is designated) attached to its outside surface. A mixture of deactivated catalyst and entrained catalytically cracked product flows downward from a dense bed 95 to the inlet 94 of the catalyst stripper. Steam is introduced to the catalyst stripper near the bottom through conduit 75 and perforated steam distribution ring 71. Steam flows upward around the frustoconical baffles, stripping catalytically cracked product off the deactivated catalyst. The catalyst flows downward through the catalyst stripper and exits through valved standpipe 72.

Hot regenerated catalyst fluidized in a stream of flue gas enters the catalyst stripper through conduit 80. Conduit 80 may join a single heat exchanger conduit 76 which winds through the frustoconical baffles 74A, 74B and 74C. The cooled mixture of flue gas and regenerated catalyst leaves the heat exchanger conduit and flows to the regenerated catalyst standpipe 6 through conduit 81. In an alternate embodiment, not shown, conduit 80 may be joined with a plurality of vertical or horizontal tubes resembling a heat exchanger bank. The cooled mixture of flue gas and regenerated catalyst flowing out of the tubes is consolidated and similarly leaves the catalyst stripper through conduit 81.

What is claimed is:

1. A riser-reactor fluid catalytic cracking process comprising the steps of:

(a) mixing a hydrocarbon feed with hot regenerated cracking catalyst in the bottom section of a substantially vertical reactor riser to form a vapor-liquid suspension in said bottom section of said reactor riser at a temperature of about 525° to 650° C.;

(b) passing the mixture of step (a) upwardly through the reactor riser under selected temperature and residence time conditions to catalytically crack at least a portion of said hydrocarbon feed whereby said cracking catalyst is deactivated;

(c) flowing said mixture of step (b) through separation means to effect separation of catalyst particles from hydrocarbon conversion products;

(d) stripping hydrocarbon from said separated deactivated catalyst particles of step (c) by countercurrently contacting said catalyst particles with a stripping gas in an annular stripping zone, said annular stripping zone being concentric with a lower section of said reactor riser;

(e) withdrawing stripped deactivated catalyst from said annular stripping zone of step (d);

(f) regenerating said withdrawn deactivated catalyst of step (e) in a regeneration zone remote from and in valved communication with said reactor riser at a temperature above that of said stripping zone whereby a hot flue gas is generated;

(g) withdrawing a controlled volume of hot regenerated cracking catalyst from a lower section of said regeneration zone;

(h) fluidizing said hot regenerated cracking catalyst of step (g) in a stream of hot flue gas withdrawn from said regeneration zone of step (f); and (i) indirectly transferring at least a portion of the thermal energy of said fluidized mixture of step (h) to said stripping zone of step (d) to heat said stripping zone of step (d) and to cool said fluidized mixture of regenerated cracking catalyst and regenerator flue gas.

2. The process of claim 1 wherein said step (i) further comprises positioning conduit means within said stripping zone of step (d) and flowing said fluidized mixture of step (h) through said conduit means.

3. The process of claim 2 further comprising controlling the flow of said mixture of hot flue gas and regenerated catalyst through said conduit means at a flow rate such that said stripping zone of step (d) is heated to a temperature sufficient to enhance separation of catalyst and hydrocarbon product.

4. The process of claim 3 wherein said flow of said mixture of hot flue gas and regenerated catalyst is controlled to increase the temperature of said stripping zone by at least 28° C. (50° F.).

5. The process of claim 1 further comprising flowing said cooled fluidized mixture of regenerated cracking catalyst and regenerator flue gas to said reactor riser of step (a).

6. A method for improving product yield in a fluidized catalytic cracking process for upgrading a hydrocarbon feed mixture containing gas oil and heavier fractions by improving separation between coked cracking catalyst and hydrocarbon liquid entrained with said coked cracking catalyst, said method comprising the steps of:

(a) providing a longitudinally extensive reaction zone having means located in a lower portion thereof for admitting said hydrocarbon feed mixture and a cracking catalyst;

(b) flowing hot regenerated cracking cracking catalyst to said lower portion of said longitudinally extensive reaction zone of step (a);

(c) contacting said hydrocarbon feed mixture containing gas oil and heavier fractions with said hot regenerated cracking catalyst of step (b) in said lower portion of said longitudinally extensive reaction zone to at least partially vaporize said hydrocarbon feed mixture and to form a fluidized suspension of cracking catalyst in said hydrocarbon feed mixture;

(d) catalytically cracking said hydrocarbon feed mixture contained in said fluidized suspension of step (c) whereby said cracking catalyst is deactivated by coke accumulation and whereby liquid hydrocarbons are entrained with said cracking catalyst;

(e) countercurrently contacting said deactivated cracking catalyst containing of step (d) with a substantially inert stripping gas in an annular stripping zone to remove entrained liquid hydrocarbons from said deactivated cracking catalyst, said annular stripping zone being concentric with a lower section of said reactor riser;

(f) withdrawing stripped deactivated catalyst from said annular stripping zone of step (e);

(g) regenerating said withdrawn deactivated catalyst of step (f) in a regeneration zone remote from and in valved communication with said reactor riser at a temperature above that of said stripping zone whereby a hot flue gas is generated;

(h) withdrawing a controlled volume of hot regenerated cracking catalyst from a lower section of said regeneration zone;

(i) withdrawing a controlled stream of flue gas from said regeneration zone of step (g);

(j) fluidizing said hot regenerated cracking catalyst of step (h) in a stream of hot flue gas withdrawn from said regeneration zone of step (g);

(k) imparting to said hot flue gas sufficient pressure to convey said fluidized hot regenerated cracking catalyst of step (j) to said annular stripping zone of step (e); and (l) indirectly transferring at least a portion of the thermal energy of said fluidized mixture of step (i) to said stripping zone of step (e) to heat said stripping zone of step (e) and to cool said fluidized mixture of regenerated cracking catalyst and regenerator flue gas.

7. The process of claim 6 wherein said step (1) further comprises positioning conduit means within said stripping zone of step (e) and flowing said fluidized mixture of step (i) through said conduit means.

8. The process of claim 7 further comprising controlling the flow of said mixture of hot flue gas and regenerated catalyst through said conduit means at a flow rate such that said stripping zone of step (e) is heated to a temperature sufficient to enhance separation of catalyst and hydrocarbon product.

9. The process of claim 8 wherein said flow of said mixture of hot flue gas and regenerated catalyst is controlled to increase the temperature of said stripping zone by at least 28° C. (50° F.).

10. The process of claim 6 further comprising flowing said cooled fluidized mixture of regenerated cracking catalyst and regenerator flue gas to said longitudinally extensive reaction zone of step (a).

* * * * *